US012722874B2

(12) United States Patent
Heo

(10) Patent No.: US 12,722,874 B2
(45) Date of Patent: Sep. 1, 2026

(54) SILICONE VINYL TUBE ASSEMBLY

(71) Applicant: Young Ho Heo, Gyeongsangnam-do (KR)

(72) Inventor: Young Ho Heo, Gyeongsangnam-do (KR)

(73) Assignee: Young Ho Heo, Gyeongsangnam-do (KR)

( * ) Notice: Subject to any disclaimer, the term of this patent is extended or adjusted under 35 U.S.C. 154(b) by 118 days.

(21) Appl. No.: 18/868,477

(22) PCT Filed: May 25, 2023

(86) PCT No.: PCT/KR2023/007117
§ 371 (c)(1),
(2) Date: Nov. 22, 2024

(87) PCT Pub. No.: WO2023/234628
PCT Pub. Date: Dec. 7, 2023

(65) Prior Publication Data

US 2026/0208942 A1 Jul. 23, 2026

(30) Foreign Application Priority Data

May 30, 2022 (KR) ..... 20-2022-0001314

(51) Int. Cl.
*B65D 83/00* (2006.01)

(52) U.S. Cl.
CPC ..... *B65D 83/7713* (2025.01)

(58) Field of Classification Search
CPC ..... B65D 83/7713
(Continued)

(56) References Cited

U.S. PATENT DOCUMENTS 1,555,711 A * 9/1925 Hershinger ..... F16N 37/02 222/327
5,044,471 A * 9/1991 Machek ..... F16N 3/12 222/326

(Continued)

FOREIGN PATENT DOCUMENTS

KR 20-0194281 Y1 9/2000
KR 10-1178376 B1 8/2012

(Continued)

OTHER PUBLICATIONS

International Search Report from corresponding PCT Application No. PCT/KR2023/007117, dated Aug. 17, 2023.

*Primary Examiner* — Paul R Durand
*Assistant Examiner* — Randall A Gruby
(74) *Attorney, Agent, or Firm* — Harness, Dickey & Pierce, P.L.C.

(57) ABSTRACT

A silicone vinyl tube assembly includes: opening member including main body having first opening formed in front-rear direction, two wings formed on opposite sides of main body, first screw section adjacent to two wings, and second screw section adjacent to first screw section and having outer diameter smaller than outer diameter of first screw section; vinyl tube including two layers of vinyl sheets to form space in which silicone sealant is filled therebetween, wherein second opening in which two wings are inserted and bonded is formed between two layers of vinyl sheets; stopper detachably coupled to second screw section; cap detachably coupled to first screw section and configured to be mounted in opening on one side of cylinder for mounting on silicone gun; and compression member being inserted into opening on an opposite side of the cylinder and to compress vinyl tube using silicone gun.

1 Claim, 4 Drawing Sheets

(58) Field of Classification Search
USPC ..... 220/495.06; 53/467, 468, 469; 222/327, 222/391
See application file for complete search history.

(56) References Cited

U.S. PATENT DOCUMENTS

| | | | | | |
|---|---|---|---|---|---|
| 5,305,920 | A * | 4/1994 | Reiboldt | B65D 83/771 | 222/105 |
| 6,494,345 | B2 * | 12/2002 | Schrader | A21C 15/005 | 222/326 |
| 6,578,738 | B1 * | 6/2003 | Keller | B65D 75/5883 | 222/326 |
| 7,445,135 | B2 * | 11/2008 | Miyata | B65D 83/76 | 222/326 |
| 8,172,109 | B2 * | 5/2012 | Cadden | B65D 83/7713 | 222/326 |
| 8,544,686 | B2 * | 10/2013 | Williams | B05C 17/00583 | 222/402.1 |
| 8,910,831 | B2 * | 12/2014 | Williams | B05C 17/0146 | 222/402.1 |
| 9,067,711 | B2 * | 6/2015 | Melia | B05C 17/0123 | |
| 9,114,415 | B2 * | 8/2015 | Williams | B05C 17/015 | |
| 9,694,944 | B2 * | 7/2017 | Long | B65D 35/30 | |
| 11,859,763 | B2 * | 1/2024 | Nakamura | B65D 83/7713 | |
| 2012/0267394 | A1 * | 10/2012 | Pierson | B65D 35/285 | 222/145.5 |

FOREIGN PATENT DOCUMENTS

| | | | |
|---|---|---|---|
| KR | 10-2013-0065213 | A | 6/2013 |
| KR | 10-2014-0042437 | A | 4/2014 |
| KR | 10-2021-0041958 | A | 4/2021 |

* cited by examiner

SILICONE VINYL TUBE ASSEMBLY

CROSS-REFERENCE TO RELATED APPLICATIONS

This application is a national phase application of PCT Application No. PCT/KR2023/007117, filed on May 25, 2023, which claims benefit of Korean Patent Application No. 20-2022-0001314 filed May 30, 2022. The entire disclosure of the applications identified in this paragraph are incorporated herein by references.

TECHNICAL FIELD

The present disclosure is directed to a silicone vinyl tube assembly.

BACKGROUND

In general, silicone sealant is widely used as a material for fixing frames or finishing cracks in various construction or interior construction projects. A cylindrical silicone container in which silicone sealant is stored is well known as a tool used for such silicone work. The silicone container is made of plastic material. A nozzle for discharging the silicone sealant is provided at the front end of the silicone container. When the silicone container is mounted on a silicone gun, the tip of the nozzle is partially cut, and then the rear side of the silicone container is pressed by the silicone gun so that the silicone sealant is discharged.

SUMMARY

However, since the silicone container has a cylindrical shape, there is a problem in that the silicone container occupies a considerable storage space. In addition, since the silicone container made of plastic material is discarded after a single use, there is a problem in that it causes environmental pollution.

In order to solve such problems of the conventional technology, the present disclosure is configured to form an opening member provided on a vinyl tube in an easily attachable and flat shape, thereby reducing the volume of the vinyl tube. Further, since the opening member includes a plurality of screw sections to which a stopper, a cap, and a nozzle are coupled, respectively, the vinyl tube may be refilled with silicone sealant and reused multiple times by opening and closing the stopper.

According to the present disclosure, a silicone tube may be collected in a state in which the stopper is locked after use. Then, the silicone sealant is refilled after opening the stopper. Thereafter, the silicone tube may be reused at a silicone work site in a state in which the stopper is locked again. Therefore, an eco-friendly vinyl tube structure, which eliminates the generation of vinyl tube waste at the silicone work site, is provided.

In addition, according to the present disclosure, since the opening member having flat wings is interposed between vinyl sheets and the wings are heat-welded on both sides, an opening may be easily produced in a flat silicone vinyl tube without generating a gap.

According to the present disclosure, a flat opening member having opposite wings, each of which tapers toward the end, is inserted into the opening of the vinyl tube and the wings are heat-welded. Therefore, the flat opening member may be easily bonded without a gap. Since the opening member has a first screw section and a second screw section with different outer diameters from each other, the silicone sealant can be filled while opening and closing the stopper. Therefore, the vinyl tube can be reused. The cap is screw-coupled to the first screw section. The nozzle is screw-coupled to the second screw section instead of the stopper.

Embodiments according to one aspect of the present disclosure are directed to a silicone vinyl tube assembly. The silicone vinyl tube assembly according to an exemplary embodiment includes: an opening member including a main body in which a first opening is formed in front-rear directions, two wings formed on opposite sides of the main body and formed to taper toward opposite side ends in terms of a thickness in a direction that is perpendicular to opposite side directions and the front-rear directions, a first screw section provided adjacent to the two wings, and a second screw section provided adjacent to the first screw section and configured to have an outer diameter smaller than an outer diameter of the first screw section such that a nozzle can be detachably coupled to the second screw section; a vinyl tube including two layers of vinyl sheets configured to form a space in which silicone sealant is filled between the two layers of vinyl sheets, wherein a second opening in which the two wings are inserted and bonded is formed between the two layers of vinyl sheets; a stopper configured to be detachably coupled to the second screw section in a state in which the nozzle is separated from the second screw section; a cap configured to be detachably coupled to the first screw section and configured to be mounted in an opening on one side of a cylinder configured to be mounted on a silicone gun; and a compression member configured to be inserted into an opening on an opposite side of the cylinder, which is opposite to the one side, and to compress the vinyl tube using the silicone gun. When use of the silicone sealant inside the vinyl tube is completed and the stopper is separated from the second screw section, the vinyl tube is configured to be refilled with silicone sealant.

Since the silicone vinyl tube assembly according to the present disclosure is configured to allow collection and reuse of silicone vinyl tubes, which have recently been discarded at many silicone work sites, it is possible to improve the environment and productivity significantly.

The opening member includes two wings formed to taper toward the opposite side ends in terms of a thickness in a direction that is perpendicular to the opposite side directions and the front-rear directions. Therefore, the second opening formed in the vinyl tube can be formed thinly, and the opening member having the wings can be easily heat-welded with the vinyl sheets without a gap by inserting the opening member between two layers of vinyl sheets. Due to the structure of the opening member and the second opening, a thin vinyl tube can be provided, and the stacked volume of vinyl tubes can be reduced. As a result, the storage of silicone vinyl tube assemblies is easy and convenient.

In addition, the cap configured to be mounted on one side opening of the cylinder is screw-coupled to the first screw section of the opening member. The opening member has the second screw section to which the stopper and the nozzle are optionally coupled as needed. Since the first screw section and the second screw section with different outer diameters from each other are formed on the opening member according to the present disclosure, the cap can be screw-coupled to the first screw section with a large outer diameter, and the stopper or the nozzle can be screw-coupled to the second screw section with a small outer diameter.

According to the present disclosure, the vinyl tube can be easily implemented in a flat form, and is used with the cap and the nozzle assembled with the opening member as needed. Therefore, after filling the vinyl tube with the silicone sealant, the silicone vinyl tube assembly can be stored in the state in which the stopper is locked. When the silicone vinyl tube assembly is mounted on the silicone gun and used, the cap is screw-coupled to the first screw section, the stopper is separated from the second screw section, and the nozzle is mounted on the second screw section. The vinyl tube filled with the silicone sealant is inserted into the inside of the cylinder, and the cap is mounted on one end of the cylinder. The compression member is inserted into the other end of the cylinder opposite to the cap. When the silicone vinyl tube assembly is mounted on the silicone gun, the compression member compresses the vinyl tube using the silicone gun, so that the silicone sealant is discharged through the nozzle.

Since the compression member is configured to compress the vinyl tube within the cylinder, the vinyl tube can be shrunk after use, thereby minimizing the volume of the vinyl tube. After the cylinder is separated from the silicone gun, the cap is separated from the cylinder, so that the vinyl tube is separated from the cylinder. Then, the cap is separated from the first screw section, and the nozzle is separated from the second screw section of the opening member. The silicon vinyl tube assembly can be collected in a state in which the stopper is screw-coupled to the second screw section.

The silicone vinyl tube assembly according to the present disclosure is configured to be reused by stretching the shrunk vinyl tube, separating the stopper, and then refilling the vinyl tube with the silicone sealant. According to the present disclosure, the silicone vinyl tube assembly can be reused until the vinyl tube is damaged and unusable. As a result, waste generated at the silicone work site can be significantly reduced. In addition, as a result of experiments, the vinyl tube according to the present disclosure could be used 5 times or more. Through the reuse of the vinyl tube, vinyl tube waste can be reduced to about 20% or less compared to previous levels. This can dramatically address environmental pollution issues caused by vinyl tubes discarded in various places at silicone work sites.

DETAILED DESCRIPTION

Figure 1:
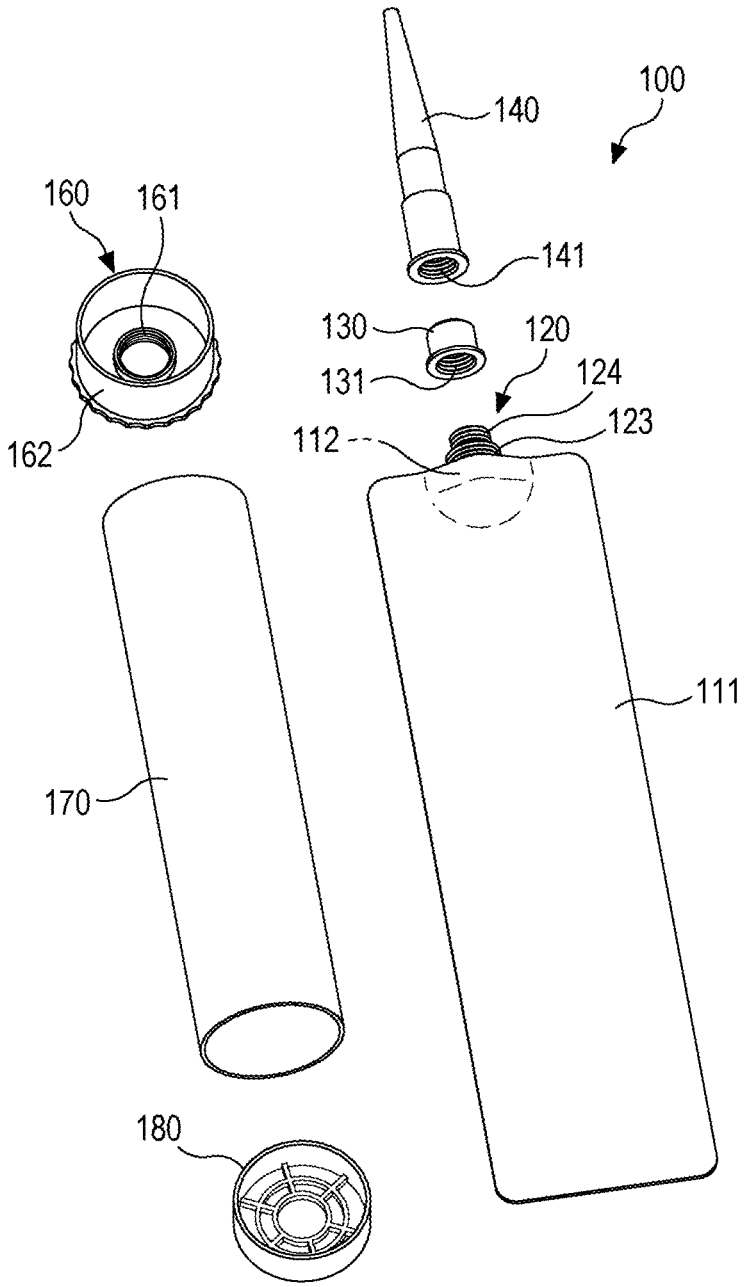
FIG. 1 is an exploded perspective view illustrating a silicone vinyl tube assembly according to an embodiment of the present disclosure.

Embodiments of the present disclosure are illustrated for the purpose of explaining the technical idea of the present disclosure. The scope of the rights according to the present disclosure is not limited to the embodiments presented below or the detailed descriptions of such embodiments.

All technical terms and scientific terms used in the present disclosure include meanings that are commonly understood by a person of ordinary skill in the art to which the present disclosure belongs unless otherwise defined. All of the terms used in the present disclosure are selected for the purpose of describing the present disclosure more clearly, and are not selected to limit the scope of rights according to the present disclosure.

As used in the present disclosure, expressions such as "including," "comprising," "having," and the like are to be understood as open-ended terms having the possibility of encompassing other embodiments, unless otherwise mentioned in the phrase or sentence containing such expressions.

The singular expressions that are described in the present disclosure may encompass plural expressions unless otherwise stated, which will be also applied to the singular expressions recited in the claims.

The expressions such as "first," "second," etc., which are shown in various embodiments of the present disclosure, are used to separate a plurality of elements from each other, and are not intended to limit an order or importance of the corresponding elements.

The directional term "front (FD)" used herein is based on a direction in which a second screw section is located relative to a first screw section in the accompanying drawings, while the directional term "rear (RD)" means a direction opposite to the front. The first and second screw sections illustrated in the accompanying drawings may be oriented differently, and these directional terms should be interpreted accordingly.

Hereinafter, embodiments of the present disclosure will be described with reference to the accompanying drawings. In the accompanying drawings, the same or corresponding components are assigned the same reference numerals. In addition, in the description of the following embodiments, redundant descriptions of the same or corresponding components may be omitted. However, even if descriptions of components are omitted, it is not intended that such components are not included in any embodiment.

FIG. 1 is an exploded perspective view illustrating a silicone vinyl tube assembly according to one embodiment of the present disclosure. FIG. 1 illustrates entire configurations of a vinyl tube 111 coupled with an opening member 120 and the opening member 120 separately. In the opening member 120 illustrated in FIG. 2, wings 121 and 122, which are flat and taper toward opposite ends along a direction perpendicular to front-rear directions FD-RD, are formed symmetrically. In the front FD of the wings 121 and 122, a first screw section 123 to which a cap 160 is screw-coupled and a second screw section 124 to which a stopper 130 or a nozzle 140 is screw-coupled are sequentially formed.

As illustrated in FIG. 1, the silicone vinyl tube assembly 100 according to one embodiment of the present disclosure includes the opening member 120, the vinyl tube 111, the stopper 130, the cap 160, and a compression member 180.

Figure 2:
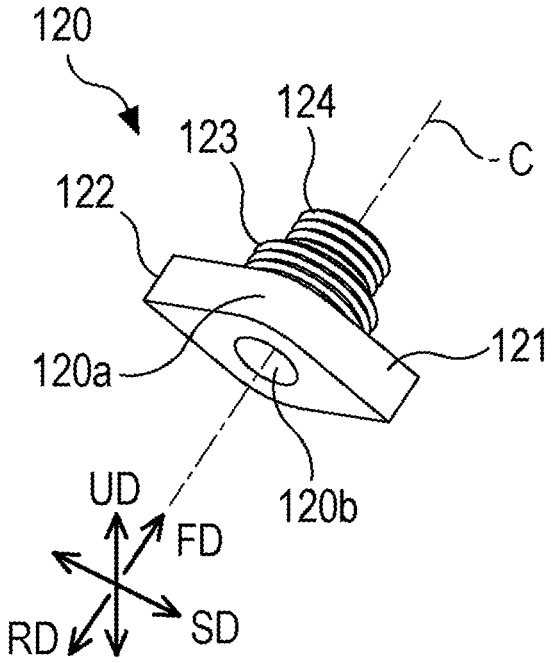
FIG. 2 is a perspective view illustrating an opening member shown in FIG. 1.

FIG. 2 is a perspective view illustrating the opening member shown in FIG. 1.

As illustrated in FIG. 2, the opening member 120 includes a main body 120*a*, the two wings 121 and 122, the first screw section 123, and the second screw section 124. A first opening 120*b* through which silicone sealant filled or stored inside the vinyl tube 111 can pass is formed in the main body 120*a*. The first opening 120*b* is formed in the front-rear directions FD-RD in the main body 120*a*. The two wings 121 and 122 are formed in opposite side directions SD of the main body 120*a* and are inserted and welded to a second opening 112 in the vinyl tube 111. The two wings 121 and 122 taper toward the ends along the opposite side directions SD in terms of a thickness in up-down directions UD, which is perpendicular to the opposite side directions SD and the front-rear directions FD-RD. The first screw section 123 is disposed adjacent to the two wings 121 and 122 (or the main body 120*a*). For example, the first screw section 123 is a male screw provided in the front FD of the wings 121 and 122. A cap 160 is screw-coupled to the first screw section 123. The second screw section 124 is disposed adjacent to the first screw section 123. The second screw section 124 has an outer diameter smaller than the outer diameter of the first screw section 123. For example, the second screw section 124 is a male screw provided in the front FD of the first screw section 123. The second screw section 124 is configured to be detachably coupled to the nozzle 140 or the stopper 130.

The vinyl tube 111 includes two layers of vinyl sheets configured to form therebetween a space which is filled with silicone sealant. A second opening 112 for inserting the two wings 121 and 122 between the two layers of vinyl sheets and bonding the two wings 121 and 122 to the two layers of vinyl sheets is formed. The wings 121 and 122 of the opening member 120 may be inserted into the second opening 112 and heat-welded along with the marginal bonding portions of the vinyl sheets. As another example, the vinyl tube 111 may be formed by heat-welding the remaining marginal portion of the vinyl tube 111 except for the second opening 112 as the portion which forms a vinyl envelope, and then inserting the wings 121 and 122 of the opening member 120 into the second opening 112 and heat-welding them. The interior of the vinyl tube 111 may be filled and refilled with the silicone sealant through the opening member 120.

As illustrated in FIG. 2, the wings 121 and 122 are configured to taper toward the ends of opposite side directions SD of the main body 120*a* of the opening member 120 in terms of the thickness in the vertical directions UD. The opposite end portions of the wings 121 and 122 may be formed thin to have sharp terminal ends. By using this structure, the vinyl tube 111 may be made thin by positioning the opening member 120 in the second opening 112 between the vinyl sheets and heat-welding the wings 121 and 122. In addition, the vinyl sheets and the opening member 120 can be bonded without a gap.

The opening member 120 according to one embodiment of the present disclosure facilitates the bonding process as described above, thereby significantly improving productivity. When the vinyl tube 111 is inserted into a silicone gun and compressed or pressurized by the compression member 180, the vinyl tube 111 can be shrunk as flat as possible between the cap 160 and the compression member 180 in a cylinder 170. Due to this structure, the volume of the shrunk vinyl tube 111 can be minimized while minimizing the silicone sealant remaining inside the vinyl tube 111.

A second female screw section 131, which is screw-coupled to the second screw section 124, is formed inside the stopper 130. The stopper 130 is configured to be detachably coupled to the second screw section 124 while the nozzle 140 is separated from the second screw section 124. For example, the stopper 130 is configured to be screw-coupled to the second screw section 124 of the opening member 120 to close the opening member 120 or to be separated from the second screw section 124 to open the opening member 120. The stopper 130 is fastened to the opening member 120 during or after use of the silicone sealant, thereby preventing the silicone sealant from being cured. After use, the vinyl tube 111 is separated from the silicone gun, and then the nozzle 140 and the cap 160 are separated from the opening member 120. Then, the stopper 130 is fastened to the second screw section 124 of the opening member 120. After use, the vinyl tube 111 may be collected in a state in which the stopper 130 is fastened to the second screw section 124. The collected vinyl tube 111 is stretched for refilling, and then the silicone sealant is refilled in a state in which the stopper 130 is separated. When the refilling is completed, the vinyl tube 111 may be supplied to a silicone work site in the state in which the stopper 130 is fastened to the second screw section 124. Therefore, according to one embodiment of the present disclosure, the vinyl tube 111 can be refilled with silicone sealant multiple times for reuse.

The cap 160 is configured to be detachably coupled to the first screw section 123 of the opening member 120. The cap 160 is configured to be mounted on one side opening of the cylinder 170 for mounting on the silicone gun. A first female screw section 161 is formed in the center of the cap 160 to be screw-coupled to the first screw section 123. A mounting portion 162 is formed on the outer periphery of the cap 160 to be spaced radially outward from the first female screw section 161 to be inserted into the inside of one end of the cylinder 170 or to be fitted to the outside of the one end of the cylinder 170.

The cylinder 170 is a member for mounting the vinyl tube 111 on the silicone gun. The cylinder 170 has a hollow cylindrical shape. The opening on one side of the cylinder 170 may refer to an opening formed toward the front FD, while the opening on the opposite side of the cylinder 170 may refer to an opening formed toward the rear RD, opposite to the opening on the one side.

The compression member 180 is configured to be inserted into the opening on the opposite side of the cylinder 170 and to compress the vinyl tube 111 toward the front FD using the silicone gun. The compression member 180 may have an outer diameter smaller than the inner diameter of the cylinder 170, thereby allowing the compression member 180 to be inserted into and move relative to the cylinder 170.

A third female screw section 141 is formed on the inside (i.e., in the rear RD) of the nozzle 140. The third female screw section 141 of the nozzle 140 is coupled to the second screw section 124 of the opening member 120. Since the nozzle 140 is coupled to the opening member 120, the silicone sealant filled in the vinyl tube 111 is discharged to the portion where the silicone sealant is to be applied through the opening member 120 and the nozzle 140.

When the silicone sealant inside the vinyl tube 111 is fully used and the stopper 130 is separated from the second screw section 124, the vinyl tube is configured to be refilled with silicone sealant.

Figure 3:
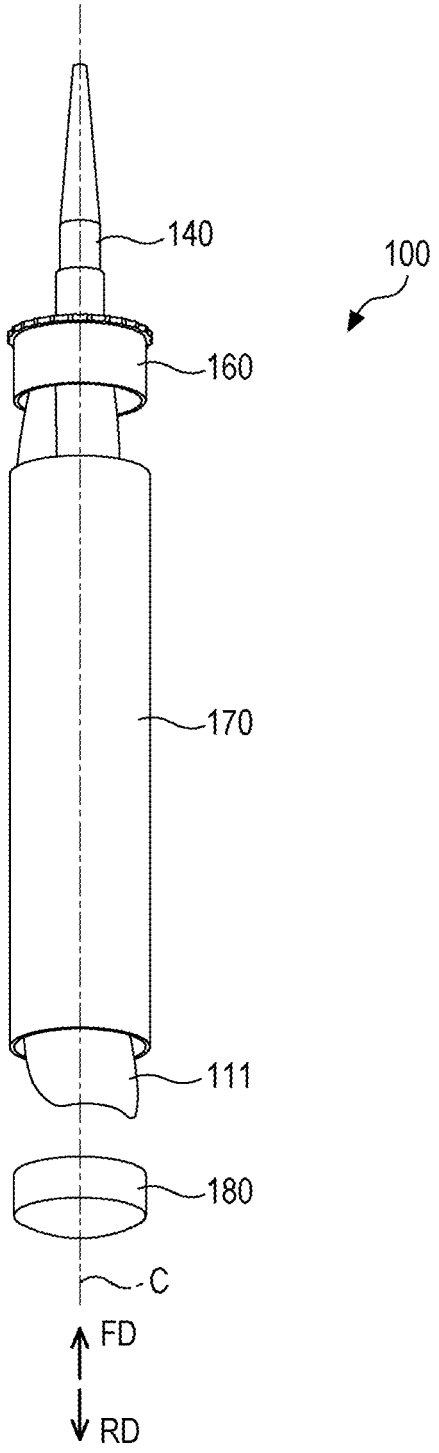
FIG. 3 is an exploded perspective view illustrating the silicone vinyl tube assembly shown in FIG. 1 in a partially disassembled state.
Figure 4:
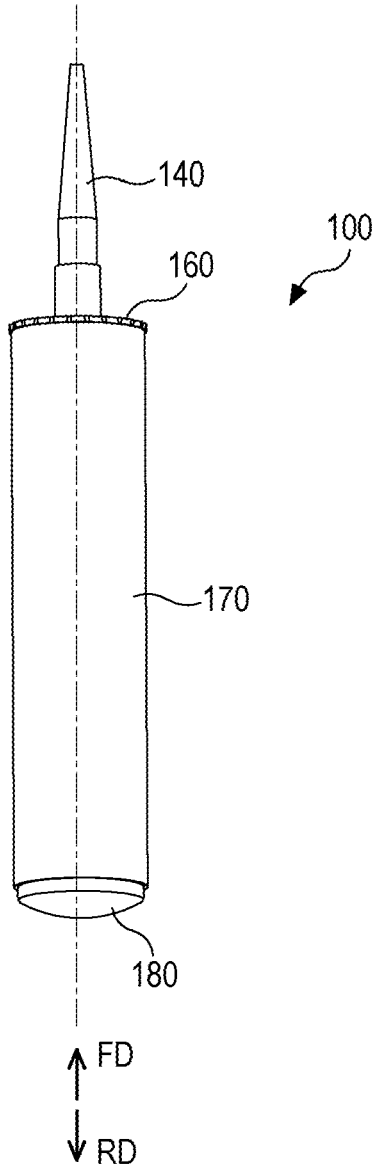
FIG. 4 is a perspective view illustrating the silicone vinyl tube assembly shown in FIG. 1.

FIG. 3 is an exploded perspective view illustrating the silicone vinyl tube assembly shown in FIG. 1 in a partially disassembled state. FIG. 4 is a perspective view illustrating the silicone vinyl tube assembly shown in FIG. 1.

As illustrated in FIG. 3, the vinyl tube 11 filled with silicone sealant is inserted into the inside of the cylinder 170 in the state in which the first female screw section 161 of the cap 160 is screw-coupled to the first screw section 123 of the opening member 120 and the third female screw section 141 of the nozzle 140 is coupled to the second screw section 124 of the opening member 120. As illustrated in FIG. 4, the mounting portion 162 of the cap 160 is mounted and fixed inside the one end of the cylinder 170, and the compression member 180 is inserted into the inside of the other end of the cylinder 170. The silicone vinyl tube assembly 100 in the state illustrated in FIG. 4 is inserted into the silicone gun, and the silicone sealant filled in the vinyl tube 111 is discharged by compressing the compression member 180.

In the foregoing, the technical idea of the present disclosure has been described with reference to some embodiments and examples illustrated in the accompanying drawings. However, it should be understood that various substitutions, modifications, and alterations may be made without departing from the technical idea and scope of the present disclosure, as understood by those of ordinary skill in the technical field to which the present disclosure pertains. In addition, such substitutions, modifications, and alterations should be considered as falling within the scope of the appended claims.

What is claimed is:

1. A silicone vinyl tube assembly comprising:

an opening member including a main body in which a first opening is formed in front-rear directions, two wings formed on opposite sides of the main body and formed to taper toward opposite side ends in terms of a thickness in a direction that is perpendicular to opposite side directions and the front-rear directions, a first screw section provided adjacent to the two wings, and a second screw section provided adjacent to the first screw section and configured to have an outer diameter smaller than an outer diameter of the first screw section such that a nozzle can be detachably coupled to the second screw section;

a vinyl tube including two layers of vinyl sheets configured to form a space in which silicone sealant is filled between the two layers of vinyl sheets, wherein a second opening in which the two wings are inserted and bonded is formed between the two layers of vinyl sheets;

a stopper configured to be detachably coupled to the second screw section in a state in which the nozzle is separated from the second screw section;

a cap configured to be detachably coupled to the first screw section and configured to be mounted in an opening on one side of a cylinder configured to be mounted on a silicone gun; and a compression member configured to be inserted into an opening on an opposite side of the cylinder, which is opposite to the one side, and to compress the vinyl tube using the silicone gun, wherein, when use of the silicone sealant inside the vinyl tube is completed and the stopper is separated from the second screw section, the vinyl tube is configured to be refilled with silicone sealant.

* * * * *